United States Patent [19]

Hägg et al.

[11] 4,404,740

[45] Sep. 20, 1983

[54] METHOD FOR MOUNTING A WINDING IN A TRANSFORMER

[75] Inventors: Rune Hägg; Lennart Lundström, both of Ludvika, Sweden

[73] Assignee: ASEA Aktiebolag, Västeras, Sweden

[21] Appl. No.: 175,632

[22] Filed: Aug. 6, 1980

[30] Foreign Application Priority Data

Aug. 9, 1979 [SE] Sweden ..... 7906678

[51] Int. Cl.[3] ..... H01F 41/02

[52] U.S. Cl. ..... 29/606; 29/446; 29/609; 336/197

[58] Field of Search ..... 29/606, 609, 446; 336/197

[56] References Cited

U.S. PATENT DOCUMENTS 2,466,448 4/1949 Lentz ..... 29/606 X
3,320,567 5/1967 Hoeft ..... 336/197
3,381,252 4/1968 Lutz ..... 336/197
4,172,245 10/1979 Link ..... 29/606 X

FOREIGN PATENT DOCUMENTS 100580 9/1973 Fed. Rep. of Germany .

*Primary Examiner*—Carl E. Hall
*Attorney, Agent, or Firm*—Watson, Cole, Grindle & Watson

[57] ABSTRACT

The present invention relates to a method for mounting transformer windings on the core legs. After all the windings for a core leg have been pre-assembled, they are pressed in a separate press to the desired height, whereafter the windings are provided with screw clamps or the like, applicable from the outside, which hold the windings in a compressed position until they have been applied on a core leg and the upper yoke of the transformer has been interleaved and the press beams been mounted. Thereafter, the screw clamps are removed.

4 Claims, 2 Drawing Figures

METHOD FOR MOUNTING A WINDING IN A TRANSFORMER

BACKGROUND

1. Field of the Invention

This invention relates to the mounting of windings in transformers, and more particularly to a method for applying compressive pressure to the winding by clamping the winding parts.

2. Prior Art

Windings in transformers are exposed to very great force in the event of a short-circuit, which forces act in a compressing manner in the axial direction of the winding. It is therefore important that the winding in the finished transformer is held under a compressing pressure which is equal to or greater than the contracting force by which the maximum allowable short-circuit current endeavours to contract the winding parts. In this way, the winding is released from its axial support and permanent deformations may arise only when the short-circuit current exceeds said value. In view of this, various attempts have been made to achieve the desired high compressing pressure.

One method comprises prepressing the finished coil-formed winding in a separate press in the winding workshop to the final height of the coil. Thereafter, the coil has been removed from the press pending the mounting onto the transformer core, and the coil has almost resumed its original height when mounting is performed. In view of this, it has been necessary to make use of special press equipment with draw rods. When the windings have been fitted onto the cores of the transformer, this press equipment has been mounted, said equipment consisting of horizontal press beams positioned over the short ends of the windings and joined to draw rods running vertically over the axial length of the windings. These draw rods compress the windings to the desired height, whereafter the upper yoke is interleaved. Finally, the entire press equipment is dismantled after pressure (contraction) has been applied to the upper yoke and the interleaving joints thus have been locked.

Another method has comprised winding tapes of, for example, glass fibre in toroidal loops around the compressed coils. To achieve sufficient strength, however, such an amount of tape has to be wound on, especially in large transformers, that the tapes occupy too much space and the method therefore becomes uneconomical.

Other solutions to the problem are various constructions based on draw rods which are retained even after the coils have been mounted in the transformer. These draw rods, of course, also take up too much space, but in addition, in view of the increased risks of flash-over along the draw rods, it is not suitable to use them in transformers for high voltages.

SUMMARY OF THE INVENTION

The methods mentioned above are therefore in many cases inappropriate. According to the present invention, a considerable improvement is obtained by retaining the windings, after the compression in the seperate winding press, in the compressed position by means of clamping members applicable from the outside. These members are designed so as not to interfere with the fitting of the windings onto the core, nor with the interleaving of the upper yoke or the application of the press beams belonging to the transformer. In addition, they are specially designed to be able to be removed from the winding as soon as the press beam has assumed its position. As clamping members there may be used easily detachable screw clamps. It has also been found that it is not necessary to compress the windings directly to their final length, but they may be maintained 5 to 7% longer, corresponding to a reduction of the compressing pressure by 35%. This, in turn, reduces the stress on the clamping members.

After the upper yoke has been interleaved, the press beams have been mounted and the screw clamps have been removed, the whole transformer is finally dried, whereafter it is possible to compress the windings further by means of, for example, wedges or the like, inserted between press beams and spacing plates. In this way the desired compressing pressure is attained, which with certainty exceeds the axial contracting force generated by the permissible short-circuit current.

BRIEF DESCRIPTION OF THE FIGURES

The invention will be best understood with reference to the accompanying FIGS. 1 to 2, showing a preferred embodiment of the best mode of carrying out the invention.

DETAILED DESCRIPTION

Figure 1:
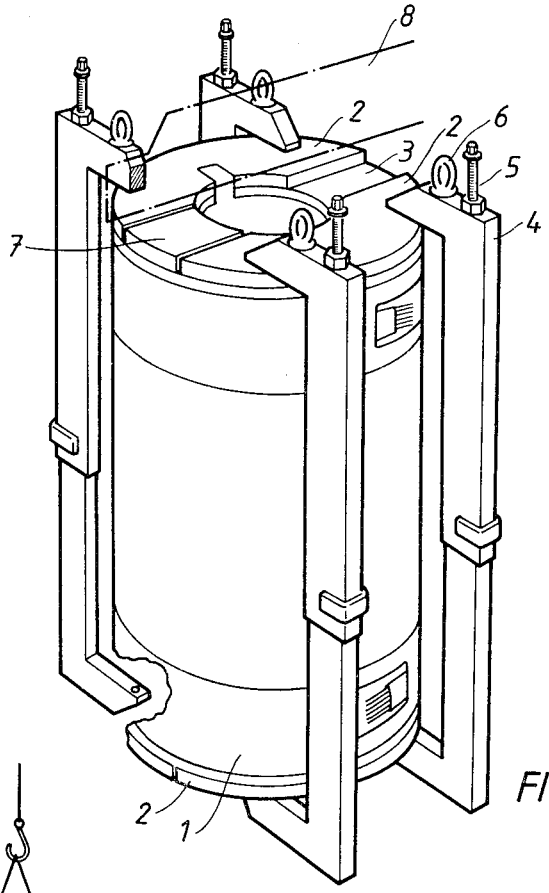
FIG. 1 shows a transformer winding retained in compressed position by screw clamps.

In FIG. 1, numeral 1 designates a complete winding unit 1 for a transformer leg and numeral 2 designates spacing plates. Below the upper spacers there is a press plate 3. The winding is pressed in the winding shop to a height corresponding to a compressing pressure of about 50 to 65% of the compressing pressure required for a finished transformer. Thereafter, the screw clamps 4 are applied so that the coil is held compressed to this height also after the winding has been removed from the press. The length of the screw clamps is adjusted by means of a bolt and nut 5. The screw clamps are provided with a special lifting eye bolt 6. The spacers 2 are positioned at a certain distance from each other, forming between them a slot for the lower portion of the yoke. The dash-dotted outline shows one of the two upper press beams 8 of the transformer.

Figure 2:
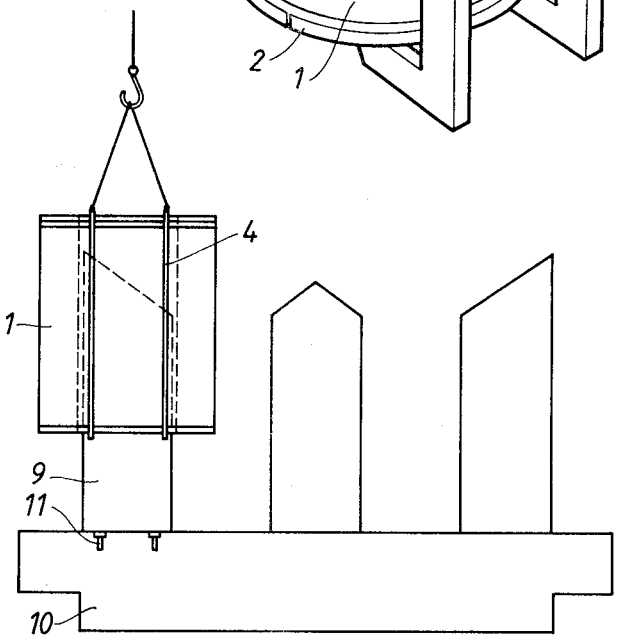
FIG. 2 shows how the winding with screw clamps is lowered down over a core leg.

FIG. 2 shows how the winding unit 1, still secured by the screw clamps 4, is lowered down over an outer core leg 9. 10 designates a lower press beam and 11 supports for the winding unit 1. The screw clamps 4 are suitably located at such a distance from each other that they may slide down on the outer sides of the supports 11.

After the winding unit 1 along with the other windings (not shown) have been lowered down into position on their respective core legs 9, the upper yoke is interleaved, the upper press beam 8 is mounted, and the screw clamps 4 are removed. An important advantage of the screw clamps 4 shown in FIG. 1 is that they may be applied so that they do not prevent the press beam from being provided with projecting supports for the spacers 2, for these supports may be fixed perpendicular to the press beam and in such a way that they will be located between the claws of the clamps or on the outside thereof.

Thereafter, the whole transformer is finally dried. After this treatment the windings 1 may become further compressed, for example by means of wedges between the upper press beam 8 and the spacers 2, thus achieving the final desired compressing pressure in the windings.

We claim:

1. Method for mounting a prepressed annular complete winding unit on a transformer core, comprising the steps of:

prepressing said winding unit to a first compressing pressure with a separate winding press within a range of approximately 50% to 65% of a final desired compressing pressure required for a finished transformer;

retaining said winding unit in a compressed condition at said first compressing pressure by adjustable clamping members engaging respective opposite upper and lower end faces of the winding unit such that said clamping members extend outside thereof;

mounting said winding unit still in said first compressed condition together with said clamping members onto a transformer core such that said lower winding unit end face rests on a lower yoke and press beam;

interleaving an upper yoke with said upper transformer core end face;

engaging an upper press beam with said upper yoke;

removing said adjustable clamping members; and then further compressing said winding unit to said final desired compressing pressure.

2. Method according to claim 1 wherein said mounting of said winding unit further comprises lowering said winding unit onto said transformer core such that said clamping members slide down outwardly of supports for said complete winding unit disposed on said lower press beam.

3. Method according to claim 1 wherein said upper yoke and said lower yoke each further comprises projecting supports fixed perpendicularly thereto and wherein said retaining of said winding unit further comprises engaging said clamping members on said winding unit so as to avoid contact of said clamping members with said projecting supports during said mounting.

4. Method according to claim 1 further comprising applying wedges between said upper press beam and said winding unit after said removing said adjustable clamping members to achieve said final compressing pressure.

* * * * *